US006705085B1

(12) United States Patent
Braithwaite et al.

(10) Patent No.: US 6,705,085 B1
(45) Date of Patent: Mar. 16, 2004

(54) DOWNHOLE ELECTRIC POWER GENERATOR

(75) Inventors: Stephen Richard Braithwaite, Rijswijk (NL); Wilhelmus Hubertus Paulus Maria Heijnen, Velsen (NL)

(73) Assignee: Shell Oil Company, Houston, TX (US)

( * ) Notice: Subject to any disclaimer, the term of this patent is extended or adjusted under 35 U.S.C. 154(b) by 11 days.

(21) Appl. No.: 10/148,112

(22) PCT Filed: Nov. 28, 2000

(86) PCT No.: PCT/EP00/12002

§ 371 (c)(1),
(2), (4) Date: Jul. 8, 2002

(87) PCT Pub. No.: WO01/40620

PCT Pub. Date: Jun. 7, 2001

(30) Foreign Application Priority Data

Nov. 29, 1999 (EP) ..... 99204027

(51) Int. Cl.[7] ..... F03G 7/00
(52) U.S. Cl. ..... 60/641.2; 290/1 R; 290/40 R
(58) Field of Search ..... 60/641.2, 39.6; 290/1 R, 1 A, 40 R

(56) References Cited

U.S. PATENT DOCUMENTS

| | | | | |
|---|---|---|---|---|
| 4,805,407 A | | 2/1989 | Buchanan | |
| 5,202,194 A | | 4/1993 | VanBerg | |
| 5,788,003 A | * | 8/1998 | Spiers | 180/65.2 |
| 5,893,343 A | * | 4/1999 | Rigazzi | 123/46 E |
| 6,181,110 B1 | * | 1/2001 | Lampis | 322/3 |
| 6,376,925 B1 | * | 4/2002 | Galich | 290/1 R |

FOREIGN PATENT DOCUMENTS

| | | | |
|---|---|---|---|
| EP | 0 500 303 A2 | 8/1992 | E21B/41/00 |
| EP | 0 909 008 A2 | 4/1999 | H02K/7/18 |

* cited by examiner

*Primary Examiner*—Hoang Nguyen

(57) ABSTRACT

A power generator for use in a wellbore formed in an earth formation, comprising an internal combustion engine having a cylinder and a piston defining a combustion chamber in the cylinder, the engine being arranged to induce a reciprocating movement to the piston relative to the cylinder upon combustion of a combustible gas mixture in the combustion chamber, and a linear electricity generator having a stator and a drive shaft, the generator being arranged to generate electricity upon a reciprocating movement of the drive shaft relative to the stator, wherein the piston is connected to the drive shaft so as to transmit said reciprocating movement of the piston to the drive shaft.

7 Claims, 2 Drawing Sheets

DOWNHOLE ELECTRIC POWER GENERATOR

FIELD OF THE INVENTION

1. Background of the Invention

The present invention relates to a power generator for use in a wellbore formed in an earth formation. The purpose of such power generator is, for example, to provide electric power to electrical wellbore equipment, to charge a battery for powering such equipment, or to create an electric charge or discharge in or around the wellbore. However, application of a conventional power generator in a wellbores is impractical or impossible in view of the relatively small diameter of the wellbore, particularly in the deeper sections of the wellbore. Furthermore, the installation of temporary power cables in a wellbore is difficult and expensive.

It is an object of the invention to provide a suitable power generator for use in a wellbore formed in an earth formation.

In accordance with the invention there is provided a power generator for use in a wellbore formed in an earth formation, comprising an internal combustion engine having a cylinder and a piston defining a combustion chamber in the cylinder, the engine being arranged to induce a reciprocating movement to the piston relative to the cylinder upon combustion of a combustible gas mixture in the combustion chamber, and a linear electricity generator having a stator and a drive shaft, the generator being arranged to generate electricity upon a reciprocating movement of the drive shaft relative to the stator, wherein the piston is connected to the drive shaft so as to transmit said reciprocating movement of the piston to the drive shaft.

SUMMARY OF THE INVENTION

The power generator can have a relatively small diameter so that the generator fits in the wellbore, by virtue of the movement of the piston and the drive shaft being a reciprocating movement.

BRIEF DESCRIPTION OF THE DRAWINGS

The invention will be further described in more detail and by way of example with reference to the accompanying drawings in which FIG. 1 schematically shows an embodiment of the power generator according to the invention.

DETAILED DESCRIPTION

Figure 1:
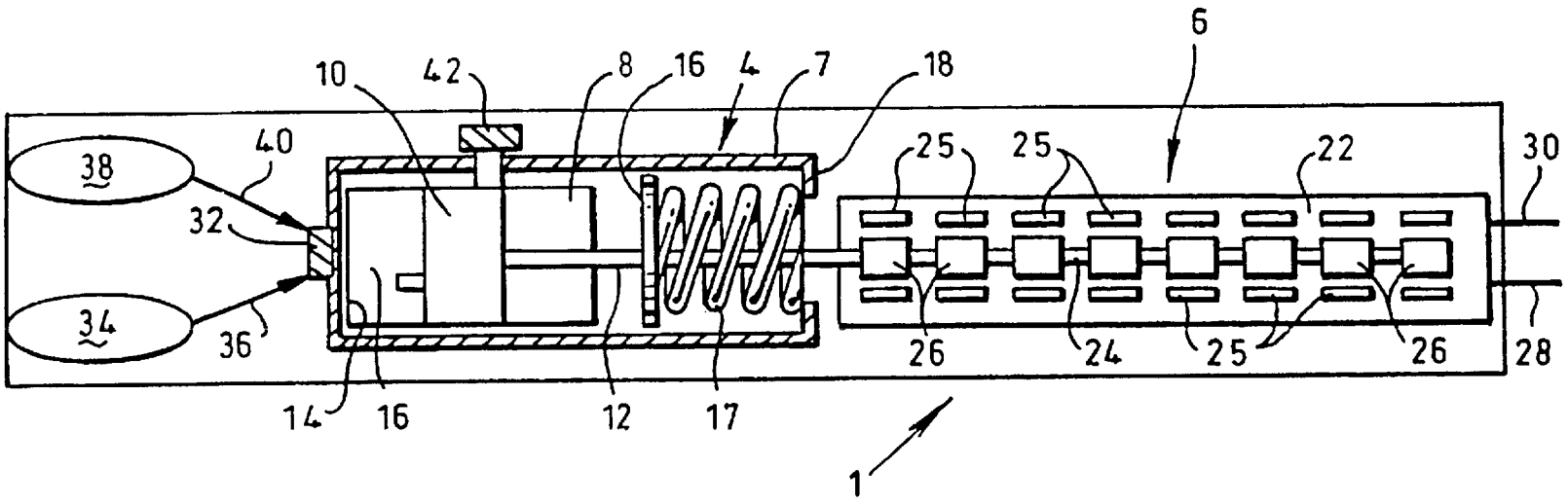

Referring to FIG. 1 there is shown a power generator 1 for use in a wellbore (not shown) formed in an earth formation (not shown). The power generator 1 includes an internal combustion engine 4 and a linear electricity generator 6 having a common longitudinal axis coinciding with, or parallel to, the longitudinal axis of the wellbore.

The engine 4 comprises a housing 7 provided with a cylinder 8 and a piston 10 extending into the cylinder 8 and being movable relative to the cylinder 8 in longitudinal direction thereof. A drive rod 12 connected to the piston 10 extends in longitudinal direction to the linear electricity generator 6. The cylinder 8 is at the end thereof opposite the drive rod 12 closed by an end wall 14, thereby defining a combustion chamber 16 formed in the cylinder 8 between the piston 10 and the end wall 14. A compression spring 17 biased at one end thereof against a circular plate 16 fixedly connected to the drive rod 12 and at the other end thereof against an annular shoulder 18 provided in the housing biases the piston 10 in the direction of the end wall 14. The combustion chamber 16 is provided with a glow plug (not shown) connected to a battery (not shown) for temporarily heating the glow plug.

The linear electricity generator 6 includes a stator 22 having a plurality of stator coils 25 and a drive shaft 24 having a plurality of magnets 26 and extending into the stator, the linear electricity generator 6 being arranged to provide an electric potential at power connections 28, 30 upon a reciprocating movement of the drive shaft 24 in longitudinal direction relative to the stator 22. The drive shaft 24 is fixedly connected to the drive rod 12 of the engine 4.

Figure 2:
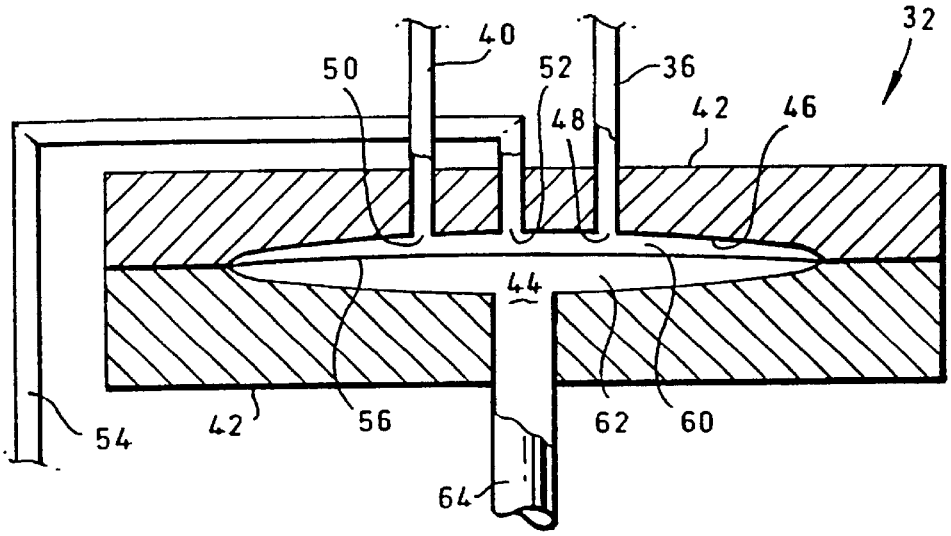
FIG. 2 schematically shows in inlet valve of the embodiment of FIG. 1.

Referring further to FIG. 2 there is shown an inlet valve 32 of the engine 4. The inlet valve 32 is in fluid communication with an oxygen reservoir 34 via a conduit 36 and with a hydrogen reservoir 38 via a conduit 40. The oxygen reservoir 34 contains a supply of oxygen at a selected pressure, and the hydrogen reservoir 38 contains a supply of hydrogen at a selected pressure. The inlet valve 32 includes a valve body 42 provided with a disc shaped chamber 44 having a valve seat surface 46 provided with a first opening 48 in fluid communication with the conduit 36, a second opening 50 in fluid communication with the conduit 40, and a third opening 52 in fluid communication with an inlet opening (not shown) provided in the wall of the cylinder 8 via a conduit 54. The position of the inlet opening is such that the piston 10 covers the inlet opening during an initial stage of the combustion stroke, and uncovers the inlet opening during a final stage of the combustion stroke. A membrane 56 divides the disc shaped chamber 44 in a first zone 60 in fluid communication with the respective openings 48, 50, 52 and a second zone 62 in fluid communication with the combustion chamber 16 via a conduit 64. The membrane 56 is flexible so as to allow the membrane to lay against the valve seat surface 46 if a fluid pressure in zone 62 exceeds a fluid pressure in zone 60.

Figure 3:
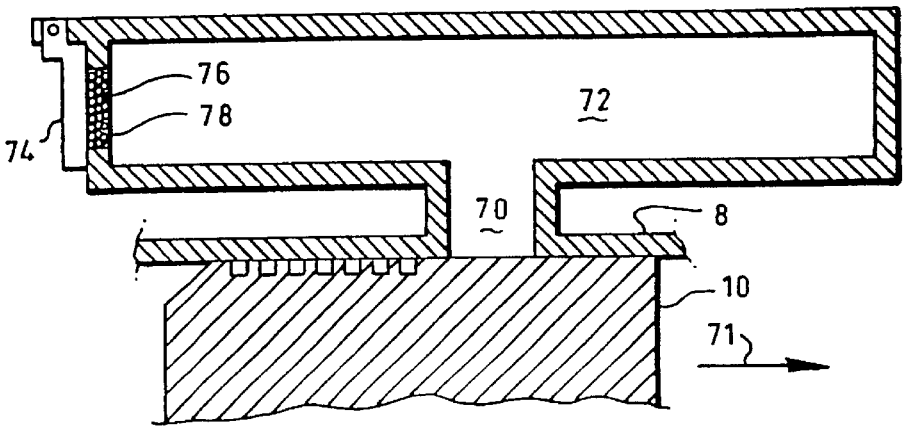
FIG. 3 schematically shows an exhaust of the embodiment of FIG. 1.

In FIG. 3 is shown an exhaust 42 of the engine 4, the exhaust including an outlet opening 70 formed in the wall of the cylinder 8. For reference purposes the piston 10 is shown together with the direction of movement 71 of the piston 10 during a combustion stroke thereof. The position of the outlet opening 70 is such that the piston substantially covers the outlet opening 70 during the initial stage of the combustion stroke, and uncovers the outlet opening 70 during the final stage of the combustion stroke. The outlet opening 70 is in fluid communication with an expansion chamber 72 provided with a non-return valve 74 allowing combusted gas to flow from the expansion chamber 72 via the non-return valve 74 to the exterior of the engine 4 and preventing inflow of fluid from exterior the engine 4 into the expansion chamber 72. The non-return valve 74 includes a passage 76 for combusted gas, which passage 76 is provided with a body of permeable material 78 including sintered steel.

During normal operation a stream of oxygen flows from the oxygen reservoir 34 via the conduit 36 into the first zone 60 of the chamber 44 and a stream of hydrogen flows from the hydrogen reservoir 38 via the conduit 40 into the first zone 60. In said first zone the streams of oxygen and hydrogen mix to form a stream of combustible gas mixture which flows via the conduit 54 into the combustion chamber 16. Ignition of the gas mixture is achieved by inducing the battery to provide an electric current to the glow plug. Upon ignition of the gas mixture, the piston 10 performs a combustion stroke in the direction of arrow 71 thereby compressing the spring 17 and moving the drive shaft 24 of the electricity generator 6 in longitudinal direction relative to the stator 22. The piston 10 uncovers the inlet opening and the outlet opening 70 during the final stage of the combustion stroke, thus allowing the combusted gas to flow via the outlet opening 70 into the expansion chamber 72. The combusted gas expands in the expansion chamber 72 and flows from there via the non-return valve 74 to the exterior of the power generator 1, thereby passing through the body of permeable material 78. The non-return valve 74 and the body of permeable material 78 prevent fluid outside the power generator from entering the expansion chamber 72.

As the combusted gas flows out of the combustion chamber 16, the pressure in the combustion chamber drops to a level below the pressure of oxygen in the oxygen reservoir 34 and hydrogen in the hydrogen reservoir 38. As a result another stream of oxygen flows from the oxygen reservoir 34 via the conduit 36 into the first zone 60 of the chamber 44 and a stream of hydrogen flows from the hydrogen reservoir 38 via the conduit 40 into the first zone 60. In said first zone the streams of oxygen and hydrogen mix to form a fresh stream of combustible gas mixture which flows via the conduit 54 and the inlet opening into the combustion chamber 16.

Upon completion of the combustion stroke, the spring 17 induces the piston 10 to perform a compression stroke whereby the piston 10 compresses the combustible gas mixture in the combustion chamber 17. During the compression stroke the pressure in the combustion chamber 16 rises to a level above the selected pressure of oxygen and hydrogen in the respective reservoirs 34, 38. Consequently the membrane 54 is biased against the valve seat surface 46 thereby closing the openings 48, 50, 52. Further inflow of combustible gas mixture into the combustion chamber 16 is thereby prevented. When the piston 10 arrives at the end of the compression stroke the pressure in the combustion chamber 17 is at a level causing the glow plug, which is still hot as a result of the previous combustion cycle, to ignite the combustible gas mixture thereby inducing the piston 10 to perform another combustion stroke. During the initial stage of the combustion stroke, the pressure in the combustion chamber 16 is even higher so that the openings 48, 50, 52 remain closed during such initial stage.

The engine then automatically performs a sequence of combustion cycles, each combustion cycle including a compression stroke followed by a combustion stroke of the piston 10, as described above. The drive shaft 24 of the linear electricity generator 6 is thereby induced to perform a reciprocating movement, and as a result electric power is generated at power connections 28, 30.

We claim:

1. A power generator for use in a wellbore formed in an earth formation, comprising an engine having a cylinder and a piston, the engine being arranged to induce a reciprocating movement to the piston relative to the cylinder, and a electricity generator having a stator and a drive shaft, the generator being arranged to generate electricity upon a movement of the drive shaft relative to the stator, wherein the piston is connected to the drive shaft so as to transmit said reciprocating movement of the piston to the drive shaft, and the engine is an internal combustion engine wherein the piston and cylinder define a combustion chamber with a spring biasing the piston so as to compares a combustible gas mixture in the combustion chamber and the piston is induced to move relative to the cylinder upon combustion of the combustible gas mixture in the combustion chamber, and that the electricity generator is a linear generator which generates electricity upon a reciprocating movement of the drive shaft relative to the stator.

2. The power generator of claim 1, further comprising an inlet valve arranged to allow a stream of said combustible gas mixture to enter the combustion chamber if the combustible gas mixture pressure in the stream exceeds the combustible gas mixture pressure in the combustion chamber.

3. The power generator of claim 2, wherein the inlet valve comprises a valve body having a valve seat surface provided with at least one opening for supplying the combustible gas mixture to the combustion chamber, and a member arranged to cover each opening if the combustible gas pressure in the stream is less than the combustible gas pressure in the combustion chamber.

4. The power generator of claim 3, wherein the valve seat surface is provided with a first opening in fluid communication with an oxidizer reservoir, a second opening in fluid communication with a fuel reservoir, and a third opening in fluid communication with the combustion chamber, the membrane being arranged to cover the first, second and third openings if the combustible gas pressure in the stream is less than the combustible gas pressure in the combustion chamber.

5. The power generator of claim 1, wherein the engine is provided with an outlet for combusted gas, the outlet including an outlet opening provided in the cylinder wall in fluid communication with an expansion chamber provided with a non-return valve allowing combusted gas to flow from the expansion chamber via the non-return valve to the exterior of the engine and preventing inflow of fluid from exterior the engine into the expansion chamber.

6. The power generator of claim 5, wherein the expansion chamber is provided with a passage for combusted gas, the passage being provided with a body of permeable material.

7. The power generator of claim 6, wherein the permeable material comprises sintered steel.

* * * * *